United States Patent [19]

Minemura et al.

[11] Patent Number: 4,497,095

[45] Date of Patent: Feb. 5, 1985

[54] APPARATUS FOR PREPARING A SUEDE-LIKE RAISED WOVEN OR KNITTED FABRIC

[75] Inventors: Norihiro Minemura; Takeo Kimura; Yoshiaki Mitsui, all of Osaka, Japan

[73] Assignee: Teijin Limited, Osaka, Japan

[21] Appl. No.: 179,396

[22] PCT Filed: Mar. 26, 1979

[86] PCT No.: PCT/JP79/00074

§ 371 Date: Dec. 13, 1979

§ 102(e) Date: Nov. 29, 1979

[87] PCT Pub. No.: WO79/00926

PCT Pub. Date: Nov. 15, 1979

[30] Foreign Application Priority Data

Apr. 13, 1978 [JP] Japan ..... 53-42643
Apr. 13, 1978 [JP] Japan ..... 53-42844

[51] Int. Cl.[3] ..... D06C 23/00
[52] U.S. Cl. ..... 26/2 R; 28/160
[58] Field of Search ..... 26/2 R, 16; 28/104, 28/160

[56] References Cited

U.S. PATENT DOCUMENTS

| | | | |
|---|---|---|---|
| 1,253,049 | 1/1918 | Kitsee | 26/16 |
| 2,241,222 | 5/1941 | Sonnino | 26/2 R |
| 2,563,259 | 8/1951 | Miller | 26/2 R X |
| 3,113,349 | 12/1963 | Nottebohm et al. | 28/104 X |
| 3,256,581 | 6/1966 | Thal et al. | 26/2 R |
| 3,613,186 | 10/1971 | Mazzone et al. | 26/2 R |
| 3,729,784 | 5/1973 | Mazzone et al. | 26/2 R |
| 3,750,236 | 8/1973 | Kalwaites | 28/104 |
| 3,769,659 | 11/1973 | Kalwaites | 28/104 |
| 3,916,823 | 11/1975 | Halloran | 26/2 R X |
| 3,997,946 | 12/1976 | Hergert | 26/2 R |

FOREIGN PATENT DOCUMENTS

| | | | |
|---|---|---|---|
| 766310 | 9/1971 | Belgium | 26/2 R |
| 1380071 | 1/1975 | United Kingdom | 26/2 R |

*Primary Examiner*—Robert R. Mackey
*Attorney, Agent, or Firm*—Sughrue, Mion, Zinn, Macpeak and Seas

[57] ABSTRACT

A process and apparatus for making the appearance of a raised fabric suede-like comprising jet spraying a high pressure liquid (12) (14) onto the nap surface of a raised fabric through the means of the liquid passable material (2) having liquid impassable parts thereon while keeping the reverse side of the raised fabric (26) in close contact with the supporter (16) whose surface has a pattern of random contour variation specified by raised parts and hollow parts, in order to make the appearance of the raised fabric, which has the nap composed of extra fine fibers of monofilament fineness in the range of 0.0001 to 0.8 denier, suede-like.

1 Claim, 10 Drawing Figures

FIG. 1A
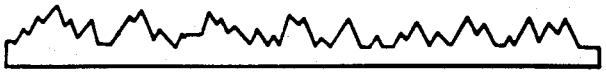
FIG. 1B
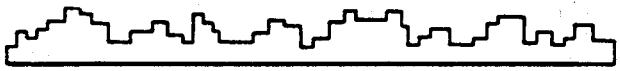
FIG. 1C
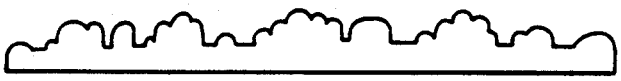
FIG. 1D
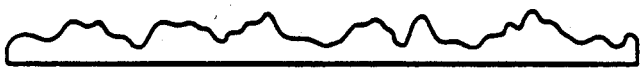
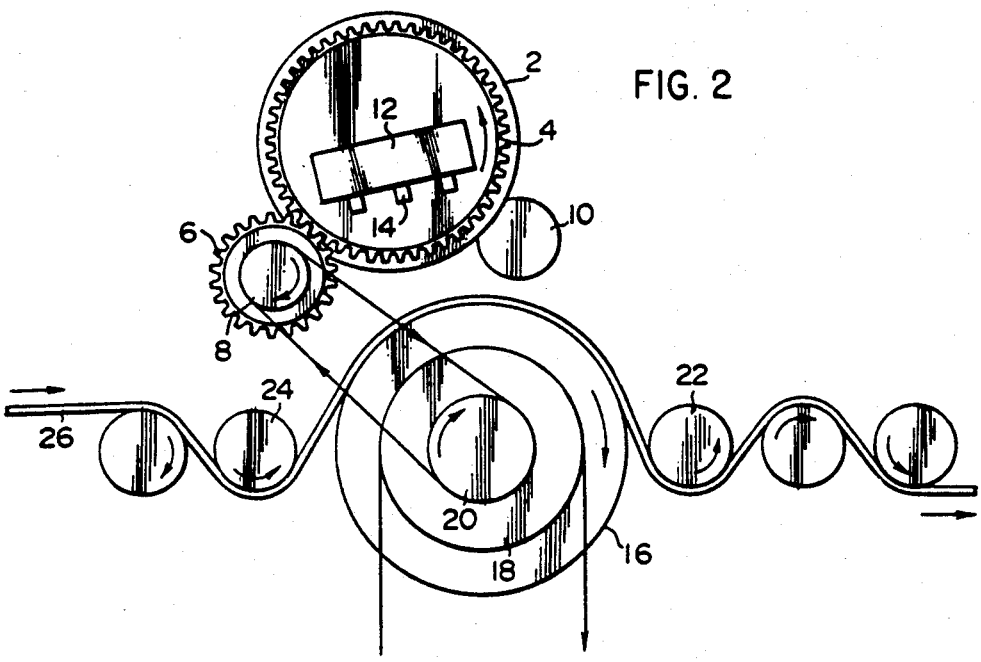
FIG. 2

APPARATUS FOR PREPARING A SUEDE-LIKE RAISED WOVEN OR KNITTED FABRIC

TECHNICAL FIELD

The present invention relates to a process and apparatus for the preparation of a suede-like raised woven or knitted fabric. More particularly, the present invention is concerned with a process and apparatus for making a raised woven or knitted fabric with the nap made of extra fine fibers having a lustrous beauty similar to natural suede and an excellent trailing effect (finger-mark property).

BACKGROUND ART

Within recent years, an artificial suede-like leather made of extra fine fibers has been developed as a substitute for suede and the demand for such a material has been encouraged by the variety and choice of clothing materials in the fashion. To provide such a suede-like artificial leather, it has been known to produce a raised fabric by buffing the surface of a woven, nonwoven, or knitted fabric made of extra fine fibers, or further to process thus produced raised fabric by applying an elastic polymer such as polyurethane polymer, etc. The conventional suede-like artificial leather has an excellent trailing effect but fails to produce a lustrous and beautiful appearance which is proper to natural suede, or, in other words, it lacks a kind of three-dimensional feeling formed by lights and shades which is the result of the anisotropic or random arrangement of naps.

Several methods have hitherto been proposed to improve the appearance of a suede-like artificial leather.

For instance, Japanese Patent Application Laid-Open No. 106701/76 discloses a method for making a suede-like artificial leather having a pattern of three-dimensional feeling on its surface, comprising the application by printing and fixation of an aqueous liquid of polyvinyl alcohol, etc. on the woven or knitted fabric; the impregnation of the fabric with a solution of polyurethane for the purpose of effecting wet solidification; the elution of the water-soluble polymer after or at the time of extraction of the solvent of polyurethane polymer; and the buffing or brushing of the fabric after drying so that those parts where the water-soluble polymer is removed are raised as naps. However, the three-dimensional pattern made according to this method has an outline sharpness and fails to produce a feeling of such three-dimensional beauty of lights and shades resulting from the anistropic or random arrangement of the nap as seen with natural suede.

Japanese Patent Application Laid-Open No. 12903/77 discloses a method for preparing a suede-like artificial leather having a soft and beautiful nappy appearance comprising the impregnation of the raised fabric with an aqueous liquid of polymer such as polyvinyl alcohol, etc. having the viscosity of more than 100 cP; squeezing of the liquid from the fabric in the due direction (direction in which the nap is oriented) under the pressure of more than 1 kg/cm$^2$ and drying of the fabric; impregnation of thus treated fabric with a water-insoluble polymer liquid such as polyurethane polymer followed by squeezing in the due direction; removal of the aqueous liquid of polymer by solution at the time of or after the solidification of the water-insoluble polymer; and buffing of the raised fabric after drying. Also in Japanese Patent Application Laid-Open No. 15801/77 a similar method, in which only a water-insoluble polymer is used, is disclosed. However, these methods can only provide a fabric whose nap is oriented uniformly in one direction and fail to produce a feeling of such three-dimensional beauty of lights and shades resulting from the anisotropic or random arrangement of the nap as seen with natural suede.

DISCLOSURE OF INVENTION

The present invention is directed to a process of preparing a raised fabric having an excellent trailing effect as well as a beautiful appearance of natural suede which is achieved by jet treating the raised fabric with a high pressure liquid to complete the invention.

The first aspect of the present invention is a process for preparing a suede-like raised fabric which comprises keeping the reverse side of a raised fabric having on its surface the nap made of monofilaments of fineness in the range of 0.0001 to 0.8 denier in close contact with the surface of the fabric supporter which has a pattern of random contour variation, and jetting a high pressure liquid onto the nap surface of said raised fabric through the liquid passable material designed not to allow the liquid to pass partially and randomly.

The second aspect of the present invention is a process for preparing a suede-like raised fabric comprising the application of an elastic polymer to the raised fabric prepared in accordance with the process described above. The first and the second aspects of this invention can be realized most effectively by the use of an apparatus disclosed by the third aspect of the present invention.

More particularly, the third aspect of the present invention relates to an apparatus for preparing a suede-like raised fabric comprising (1) a fabric supporter designed to let the raised fabric run in close contact with its surface which has a random contour variation; (2) a jet nozzle, which is located above said fabric supporter, for jetting a high pressure liquid onto the raised fabric; and (3) a liquid passable material which is located midway between the fabric supporter and the jet nozzle which has liquid impassable parts arranged partially and randomly to block the passage of the liquid to make the flow of the high pressure liquid random.

BRIEF DESCRIPTION OF DRAWINGS

FIGS. 1A–1D shows drawings to explain the contour variations effected on the surface of the fabric supporter used in the present invention.

FIG. 2 is an outline side view of an example of the preferable apparatus used in the present invention.

BEST MODE OF CARRYING OUT THE INVENTION

Figure 3:
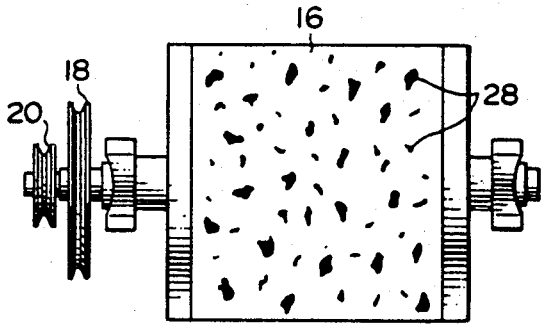
FIG. 3 is a front view of the fabric supporter.

The fabric supporter in the present invention is made in the form of a plate or a cylinder with the purpose of supporting the fabric to be treated with a high pressure liquid. As for its material, metals such as stainless steel, copper, iron, steel, iron or steel plated with nickel, etc., alminum, etc., plastics such as polyester resin, melamine resin, epoxy resin, phenolic resin, etc., rubbers such as polychloroprene, polyurethane, etc., or ceramics are used. Especially, a cylindrical fabric supporter made of metal is preferable. There are raised parts and hollow parts formed randomly to show contour variation on the surface of the fabric supporter. The fabric supporter may have any type of surface contour variations including a wide variety of shapes as shown by the sectional views of FIGS. 1A–1D, ranging from sharp profiles to round ones.

As for the shape of the raised parts and hollow parts, it is especially preferable that it has a cross section not so sharp in profile like FIGS. C or D.

The arrangement of the profile should preferably be made to keep the difference of height between the convexity and the concavity in the range of 0.5 to 10 mm and the number of raised parts in the range of 1 to 100 per 25 $cm^2$ and the hollow parts likely in the range of 1 to 100 per 25 $cm^2$, both distributed randomly. The making of a fabric supporter with a random arrangement of raised parts and hollow parts on its surface involves, for example, a method for making a cylindrical fabric supporter comprising the preparation of a gypsum mold, production by engraving of a mother mill after the gypsum mold, press work in which the obtained mother mill is transferred onto the surface of a solid-drawn steel pipe; a method for making a plate or cylindrical fabric supporter of plastic or metal by means of precision casting with the use of a gypsum mold; a method for making a cylindrical fabric supporter by directly engraving a pattern of contour variation on the surface of a solid-drawn steel pipe; and a method for making a plate-type fabric supporter by shaping a rubber material under high temperature and pressure with the use of a mold having a pattern of contour variation.

In the case where the fabric supporter is of plate type, the fabric supporter is used in combination with a belt conveyor. The raised fabric is jet treated by a high pressure liquid while the raised fabric held in close contact with the unevenly profiled surface of the fabric supporter is carried on the belt conveyor. In case where the fabric supporter is of cylindrical type, the fabric supporter is used as a roll and the raised fabric is jet treated by a high pressure liquid while it moves on the unevenly profiled surface of the roll. It is preferable to control the running speed of the fabric in the range of 1 to 20 m per minute.

As for the liquid passable material of the present invention, a wire gauze, multiperforated metal plate or plastic plate may be mentioned. When a wire gauze is to be used as a liquid passable material, liquid impassable parts can be formed on it partially and randomly by closing the meshes with metal pieces welded thereon partially and randomly. In case of metal plate or plastic plate, a method may be proposed, as an example, in which, by cutting liquid passable openings of varied shape at random, the rest of the metal plate or plastic plate will form partial and random liquid impassable parts. From the viewpoint of easiness in shaping, it is preferable to use a wire gauze of 5 to 300 mesh for a liquid passable material. It is preferable to have the opening area ratio of the liquid passable material of the present invention, or the ratio of liquid passable parts to whole area of the material, set to 10 to 80%, or more preferable to 20 to 60%.

Speaking of the high pressure liquid of the present invention, there are, for example, water, steam or air of high pressure. When water is used as a high pressure liquid, pressure should preferably be adjusted to 1 to 100 $kg/cm^2G$, more preferably to 20 to 40 $kg/cm^2G$. The temperature of water may be 10° to 80° C. In case where steam is used, it is preferable to adjust the pressure to 1 to 6 $kg/cm^2G$ and is especially preferable when adjusted to 2 to 4 $kg/cm^2G$. Steam is used when it is 120° to 180° C. In case of air, the pressure should preferably adjusted to 2 to 10 $kg/cm^2G$, or more preferably to 4 to 6 $kg/cm^2G$. Air is used at the temperature of 20° to 200° C. In the present invention, water or steam of high pressure is more preferably used. It is preferable to have the spout of a nozzle shaped like a cone or sector so that the liquid may be jetted in the conical or sectoral spray formation.

The impact pressure exerted by the high pressure liquid upon the raised fabric when the liquid hits the surface of the fabric should preferably be in the range of 300 to 5000 $kg/cm^2$. To achieve this effect, it is preferable to keep the distance between the spout of the jet nozzle and the raised fabric in the range of 0.5 to 50 cm and the distance between the spout and the liquid passable material in the range of 0.3 to 30 cm. The speed of the ejected high pressure liquid should preferably be in the range of 30 to 120 m/sec. in the case of water, 400 to 900 m/sec. in the case of steam, 200 to 600 m/sec. in the case of air. The flow rate should preferably be in the range of 1200 to 6000 $cm^3$/sec./nozzle in the case of water, 0.1 to 1 g/sec./nozzle in the case of steam, 0.01 to 0.1 $m^3$/min./nozzle in the case of air.

In the present invention, when a high pressure liquid is ejected onto the surface (on which a suede-like appearance is produced) of a raised fabric with the reverse side (on which no suede-like appearance is produced) of the raised fabric kept in close contact with the randomly contoured surface of said fabric supporter, the impact pressure exerted by the high pressure liquid on the raised fabric varies randomly according to the contour variation of the surface of the fabric supporter. Also in the present invention, the flow of the spouted high pressure liquid varies randomly as it passes through liquid passable material which is made impassable partially and randomly and hits the nappy surface of the raised fabric unevenly. In the present invention, both functions mentioned in the above work in cooperation to effect the orientation of the nap on the surface of the raised fabric extremely random, thus producing most efficiently a random nap pattern of lights and shades associated with three dimensional beauty.

Referring to the drawings, the present invention shall be explained in detail. FIG. 2 is an outline side view of an example of the preferable apparatus used in the present invention. The reference character 2 in FIG. 2 designates the cylindrical liquid passable material made of metal gauze whose meshes are closed partially and randomly and fitted with gears 4 on both sides. The driving gears 6 mesh with the gears 4 fitted on the both sides of the liquid passable material and a pulley 8 is fixed to the driving gears. A guide bearing 10 is provided a high pressure liquid header 12 is located in cylinder 2. The high pressure liquid is supplied to the high pressure liquid header from the supply source of the high pressure liquid (not shown in the drawing) and the high pressure liquid is ejected from several jet nozzles 14. The roll 16 is a cylindrical fabric supporter made of metal and there is a pattern of contour variation designed randomly on its surface. On one side of the roll a pulley 18 and pulley 20 are fixed: the pulley 18 drives the roll in combination with the power supplying device (not shown in the drawing) and the pulley 20 works in combination with the pulley 8 of the driving gear 6. The driving gear 6 does not necessarily have to work in combination with the roll 16 and they may differ from each other in the speed and direction of revolution. Guide rollers 22 and 24 keep the raised fabric 26 in close contact with the surface of the fabric supporter (roll) 16.

Figure 4:
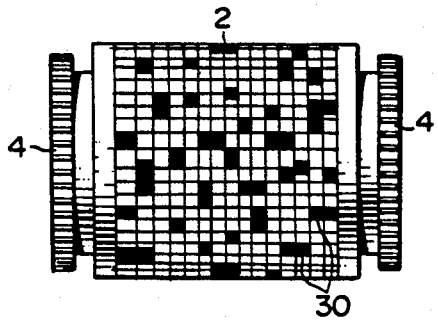
FIG. 4 is a front view of the liquid passable material.
Figure 5:
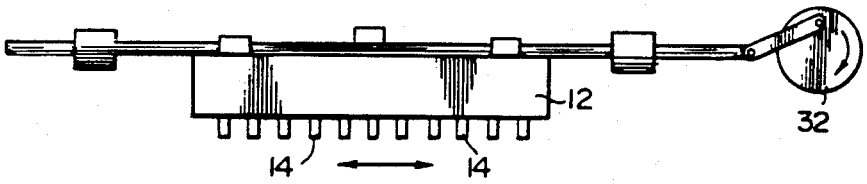
FIG. 5 is a front view of the high pressure liquid header.

FIG. 3 shows a front view of the fabric supporter (roll) 16. A pattern of contour variation 28 is shaped on the surface of the fabric supporter. FIG. 4 is a front view of the liquid passable material 2. The liquid passable material has on its surface the liquid impassable parts 30 prepared partially and randomly. More than two metal gauzes may be used in layers to form the liquid passable material to increase its strength. FIG. 5 is a front view of the high pressure liquid header 12. The high pressure liquid header is designed to perform reciprocating motion (in the vertical direction to the drawing in FIG. 2) within cylinder 2 by means of the crank mechanism 32.

In FIG. 2 the raised fabric 26 is fed from the left side with its raised surface (the surface to be processed to have a natural suede-like appearance) upside and its reverse side (the surface not to be treated to have a natural suede-like appearance) comes in close contact with the surface having contour variation of the fabric supporter (roll) 16 between the guide rollers 22 and 24. While the reverse side of the raised fabric is in close contact with the surface having contour variation of the fabric supporter (roll), the high pressure liquid is jet sprayed from the nozzles 14 onto the nappy surface of the raised fabric through the medium of the liquid passable material 2. When subjected to such jet spray treatment, the nappy surface of the raised fabric comes to have a pattern of lights and shades specialized with three-dimensional sense of beauty because of the random orientation of the nap of the raised fabric. The fabric is drawn to the right side in FIG. 2; is sometimes dried as case may require; and is wound up. The fabric thus treated can be directly submitted to the next process of elastic polymer application without being wound up.

It is preferable to run the cylindrical liquid passable material 2 at the circumferential speed of 0.1 to 30 m/min. and the fabric supporter (roll) 16 at the circumferential speed of 1 to 20 m/min. Also it is preferable to let the high pressure liquid header 12 have a reciprocal motion inside the cylindrical liquid passable material 2 at the rate of 1 to 400 reciprocation/min.

The raised fabric of the present invention comprises a woven, knitted, or nonwoven fabric, or a combined fabric thereof, having the nap made of extra fine fibers whose fineness is in the range of 0.0001 to 0.8 denier.

A raised fabric having the nap made of extra fine fibers can be prepared according to various methods publicly known heretofore, some of which, for instance, are as follows:

(1) A method which comprises preparing a fabric from extra fine fibers obtained according to a known super-drawing method or high-speed spinning method and raising one surface or both surfaces of the fabric thus prepared by use of an ordinary raising machine such as an emery raising machine, teasel raising machine, wire raising machine, and roller sanding machine equipped with sandpaper or emergy cloth.

(2) A method which comprises preparing a fabric with composite fibers which consists of more than two polymers and can be split into respective component polymers to give extra fine fibers by mechanical process and raising one surface or both surfaces of thus prepared fabric with an ordinary raising machine. (See, for instance, U.K. Patent No. 1,454,241 and U.S. Pat. No. 4,051,287.)

(3) A method which comprises preparing a fabric using islands-in-sea type composite fibers or mix-spun fibers consisting of two or more polymers, forming extra fine fibers consisting of island components by removing a sea component, and raising one surface or both surfaces of the fabric with an ordinary raising machine. (See, for instance, U.S. Pat. Nos. 3,424,604, 3,705,226 and 3,865,678.)

The raised fabric of this invention can be prepared according to the method proposed previously by one of the present inventors, which method comprises: preparing a fabric from tubular composite fibers in which axially drawn components of polyester or polyamide and components of polystyrene totaling 16 to 96 in number are alternately arranged side by side to form a single loop layer having a hollow in the center; dissolving and removing the components of polystyrene to leave the components of polyester or polyamide as extra fine fibers; raising one surface or both surfaces with an ordinary raising machine. (See, for instance, Japanese Patent Application No. 106292/77.)

The monofilament denier of the extra fine fibers is in the range of 0.0001 to 0.8 preferably 0.01 to 0.5. When the denier is less than 0.0001, surface abrasion and pilling resistance of the raised fabric are not good. When the denier is more than 0.8, feel or touch of the raised fabric tends to be rough and a suede-like touch is hardly obtained.

As for the polymers used for the preparation of extra fine fibers, there are preferably polyesters such as polyethylene terephthalate and polyamides such as nylon 6 and nylon 66.

The raised fabric thus obtained according to the present invention has an appearance of natural suede-like elegant beauty, more particularly it possesses a pattern of lights and shades specialized with three-dimensional sense of beauty resulting from the random orientation of the nap and it also possesses an excellent trailing effect because of its extra fine fibers which compose the nap.

In the present invention, when the raised fabric treated with a spray of high pressure liquid is provided with an elastic polymer, the nap orientated in the random direction is fixed at its base and accordingly the durability of the pattern of lights and shades with three-dimensional sense of beauty increases. The raised fabric thus provided with an elastic polymer also has excellent repulsive elasticity and crease resistance. Therefore the application of an elastic polymer to the raised fabric which is spray treated with a high pressure liquid is an especially favorable aspect of the present invention.

As for the elastic polymers, natural rubber and synthetic elastic polymers such as acrylonitrile-butadiene copolymer, polychloroprene, styrenebutadiene copolymer, polybutadiene, polyisoprene, ethylenepropylene copolymer, copolymers of acrylate type, silicones, polyurethane, polyacrylate, polyvinyl acetate, polyvinyl chloride, polyester-polyether block copolymer, ethylenevinyl acetate copolymer can be used. Of these, polyurethane is most preferable. In the present invention it is also preferable to adopt a method in which a urethane pre-polymer is applied to the raised fabric which is then heat-treated to form polyurethane in the raised fabric itself.

An elastic polymer is applied to the raised fabric in the form of a solution, or more particularly a solution prepared with an organic solvent or aqueous solution of the elastic polymer, or aqueous emulsion. The method of application involves such methods as immersion of the raised fabric into the solution, coating and spraying; however, from the viewpoint of achieving the uniform application of the elastic polymer into the raised fabric, the method of immersing the fabric in the solution is preferable. For immersion and spraying, it is preferable to use a solution of elastic polymer having the concentration of 1 to 50% by weight. For coating, it is preferable to use a solution of elastic polymer having the concentration of 5 to 50% by weight. The quantity of an elastic polymer (dry weight) to be applied to the raised fabric is determined depending upon the end use of the raised fabric; however, it is preferable to use an elastic polymer of 1 to 50% by weight of the raised fabric and it is more preferable to have the quantity adjusted to 3 to 20% by weight. After the application of an elastic polymer, the elastic polymer is solidified in the raised fabric according to a known wet method or a dry method.

In using a urethane pre-polymer, a heat-active urethane pre-polymer having one or more isolated isocyanate groups blocked by bisulfites, in particular, the one having an oxyethylene group of 10 to 40% by weight in the molecule, as disclosed in Japanese Patent Application Laid-Open Nos. 108395/75 and 155794/75, is preferable. Such urethane pre-polymer is applied to the raised fabric in the form of an aqueous solution or aqueous emulsion. Thereafter the raised fabric is dried and subjected to heat treatment at 100° to 180° C. for 10 sec. to 15 min. Upon heat-treating, the urethane pre-polymer in the raised fabric releases bisulfites blocking isocyanate groups to regenerate active isocyanate groups and accordingly to form a polyurethane polymer by a self-cross-linking reaction.

The raised fabric of the present invention can be dyed or printed according to an ordinary method before it is jet spray treated with a high pressure liquid. When the base of the nap is to be fixed by the application of an elastic polymer to the raised fabric, the raised fabric can be dyed or printed after the application of the elastic polymer. The raised fabric which has undergone the jet spray treatment with a high pressure liquid or further the application of an elastic polymer is subjected to the buffing and/or brushing and further to the decantizing process according to an ordinary method if necessary. Moreover, in the present invention, the raised fabric can be treated for water repellency, water proof, stain proof, antistatic, lustering, flame retardancy, self-extinguishing, etc.

The following examples will describe the present invention in greater detail.

EXAMPLES 1-4

]Preparation of a raised woven fabric]

The hollow composite filament was prepared in accordance with the method disclosed in U.S. Pat. No. 4,051,287 from polyethylene terephthalate having an intrinsic viscosity of 0.62 (measured at 35° C. in O-chlorophenol) and poly-ε-capromide having an intrinsic viscosity of 1.30 (measured at 35° C. in m-cresol), with polyester components and polyamide components totalling 16 in number arranged side by side alternately in the form of a ring to make a tubular body which extends along the longitudinal axis of the filament as shown in FIG. 6.

Figure 6:
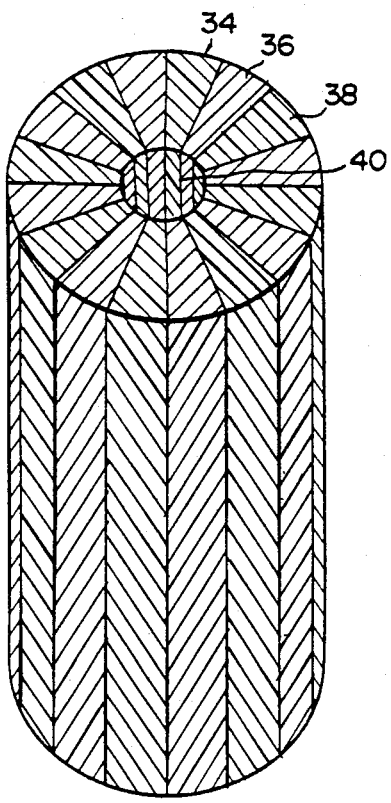
FIGS. 6 and 7 are perspective views looking at the cross sections of the hollow composite fibers from which extra fine fibers are prepared for the making of the raised fabric of the present invention.

In FIG. 6, 34 is the hollow composite filament, 36 the polyamide (poly-ε-caproamide) components, 38 the polyester (polyethylene terephthalate) components, and 40 the hollow.

In the hollow composite fiber shown in FIG. 6, the ratio of the total weight of the polyamide components to that of the polyester components was 1:1, and the fineness of the individual component segments was 0.23 denier and that of the hollow composite fiber was 3.7 deniers. The hollow ratio—the ratio by cross section area of the hollow cavity to the total of the cross section area of the polyamide component segments, polyester component segments, and the hollow cavity—was 8%.

As for the weft yarn, a single twist filament yarn of said hollow composite fiber multifilaments (300 deniers/80 filaments) having a twist number of S 120 turns/meter (T/m) was used. As for the warp yarn, a twin filament yarn (200 deniers) consisting of two 100 deniers/24 filaments wooly (false twisted) yarns of polyethylene terephthalate and having a twist number of S 150 T/m was used.

A 4-ply satin having the woven density of 70 warps/inch and 50 wefts/inch was prepared from the weft and warp yarns mentioned above.

The resultant woven fabric was relaxed in a hot water bath at a temperature of 98° C. for 30 minutes, and dried at a temperature of 120° C. for 3 minutes. An oiling agent mainly consisting of mineral oil was applied to the dried fabric. Thereafter, one surface of the woven fabric was raised 15 times with a wire raising machine of 33 count wires at a running speed of 30 m/minute. The raised woven fabric was then preheat set at a temperature of 170° C. for 30 seconds using a pin tenter type heat setter. The average fineness of the filaments which constituted the nap of the resultant raised woven fabric was 0.23 denier and the weft yarns of the raised woven fabric had an average monofilament denier of 0.45.

Thereafter, the pre-heat set raised woven fabric was dyed at a temperature of 130° C. for 60 minutes in an aqueous dyeing bath containing 4% (based on the weight of the fabric) of Duranol Blue G (C.I. No. 63305, trademark of a disperse dye produced by I.C.I.), 0.2 ml/l of acetic acid, and 1 g/l of a dispersing agent mainly containing a condensation product of naphthalene sulfonic acid with formamide. The raised woven fabric was then subjected to soaping with an aqueous solution containing a nonionic detergent at a temperature of 80° C. for 20 minutes, and dried at a temperature of 120° C. for 3 minutes.

[Jet spray treatment with a high pressure liquid]

The raised woven fabric thus obtained was subjected to a jet spray treatment according to the process shown in FIG. 2.

Molds were prepared from gypsum respectively having a pattern of contour variation as shown by a, b, c, and d of FIG. 1, after which four pieces of mother mills were engraved. The patterns of the mother mills thus obtained were transferred by press to soliddrawn steel pipes, 35 cm in diameter and 60 cm in length, to produce four cylindrical fabric supporters. Iron cores were welded to both ends of these cylindrical fabric supporters to form rolls.

The raised woven fabric thus obtained with its reverse side (the surface having no nap) kept in close contact with the surface of said roll (rotating at the rate of 2 revolutions/min.) was run at the speed of 2 m/min., during which time a jet spray treatment was conducted with the use of water as a high pressure liquid under the pressure of 20 kg/cm$^2$G and temperature of 20° C. As for the liquid passable material, a cylindrical one made of a 5-mesh wire qauze whose meshes are partially and randomly closed by welding with metal pieces of various patterns retaining the open area ratio of 30%. The distance between the spout of the jet nozzle and the liquid passable material was 2 cm; the flow speed of the high pressure water was 61.4 m/sec.; and the flow rate was 2892 cm$^3$/min./nozzle.

An experiment was conducted with the four fabric supporters in which the appearance of the obtained raised woven fabric was examined with the naked eye. The results are shown in Table 1.

It is known from Table 1 that especially good results are obtained when the pattern of the fabric supporter has no contour variation of sharp angle details (as seen in FIGS. 1C and 1D).

TABLE 1

| | Pattern of contour variation of fabric supporter | Appearance of raised woven fabrics: Randomness *1 | Shaping of pattern *2 | Sharpness of pattern *3 | Collective evaluation *4 |
|---|---|---|---|---|---|
| Example 1 | FIG. 1, a | A | A | C | B–C |
| Example 2 | FIG. 1, b | A | A | B | B |
| Example 3 | FIG. 1, c | A | A–B | A | A–B |
| Example 4 | FIG. 1, d | A | A | A | A |

Footnotes for Tables 1–5
*1: The randomness of the patterns of lights and shades formed on the surface of the raised fabric.
A: Excellent in randomness.
B: Slight regularness is observed in the patterns.
C: Considerable regularness is observed in the patterns.

*2: The shaping of the patterns of lights and shades formed on the surface of the raised fabric.
A: The patterns are shaped to a satisfactory degree.
B: The patterns are shaped to a considerable degree.
C: The patterns are shaped slightly.
*3: The outline sharpness of the patterns of lights and shades formed on the surface of the raised fabric. (It is preferable to have a dim and blurred outline)
A: The outline of the pattern is dim and blurred.
B: The outline of the pattern is slightly distinct.
C: The outline of the pattern is distinct.
*4: The results of the collective evaluations made on the randomess, degree of shaping of the patterns, outline sharpness of the patterns, and trailing effect.
A: Excellent.
B: Satisfactory.
C: Slightly unsatisfactory in view of practical use.

EXAMPLES 5–9

The raised woven fabric (unprocessed) obtained in Example 1 are jet spray processed under the same conditions as in Example 4 except that the used liquid passable materials were variously changed in the open area ratio. As for the liquid passable materials, those made of a 5-mesh wire gauze were used, with their meshes closed partially and randomly by welding with metal pieces of various patterns to achieve the variation of the open area ratio.

The raised woven fabrics thus obtained were examined with the naked eye and the results are shown in Table 2.

Table 2 indicates that especially good results were obtained when the open area ratio is in the range of 20 to 60%.

TABLE 2

| | Open area ratio (%) | Appearance of raised woven fabrics: Randomness *1 | Shaping of pattern *2 | Sharpness of pattern *3 | Collection evaluation *4 |
|---|---|---|---|---|---|
| Example 5 | 10 | A | B | A | B |
| Example 6 | 20 | A | A | A | A |
| Example 7 | 40 | A | A | A | A |
| Example 8 | 60 | A | A–B | A–B | A–B |
| Example 9 | 80 | A | B | B | B |

EXAMPLES 10–14

The raised woven fabric (unprocessed) obtained in Example 1 are jet spray processed under the same conditions as in Example 4 except that the pressure of the high pressure liquid was varied as shown in Table 3.

The appearance of the obtained raised woven fabrics was examined with the naked eye and the results are shown in Table 3.

It has been made known from Table 3 and the results of Example 4 that especially good results were obtained when the pressure of water was in the range of 20 to 40 kg/cm$^2$.

TABLE 3

| | High pressure water: Pressure (kg/cm$^2$G) | Flow speed (m/sec.) | Flow rate (cm$^3$/sec./nozzle) | Appearance of raised woven fabric: Randomness *1 | Shaping of pattern *2 | Sharpness of pattern *3 | Collective evaluation *4 |
|---|---|---|---|---|---|---|---|
| Example 10 | 5 | 30.7 | 1450 | A | C | A | C |
| Example 11 | 10 | 43.4 | 2040 | A | B | A | B |
| Example 12 | 30 | 75.1 | 2900 | A | A | A | A |
| Example 13 | 40 | 86.8 | 4090 | A | A | A | A |
| Example 14 | 60 | 106.3 | 5010 | A | B | A–B | B |

EXAMPLES 15–20

The raised woven fabrics (unprocessed) obtained in Example 1 were jet spray pocessed under the same conditions as shown in Table 4 using a liquid passable material prepared by closing the meshes of a 100-mesh wire gauze partially and randomly by welding metal pieces of various shapes (open area ratio 30%) by use of steam or air as a high pressure liquid. Other conditions were as same as those of Example 4.

The appearance of the obtained raised woven fabrics was examined with the naked eye and the results are shown in Table 4.

TABLE 4

| | High pressure liquid | | | | | Appearance of raised woven fabrics | | | |
|---|---|---|---|---|---|---|---|---|---|
| | Kind | Pressure (kg/cm²G) | Temperature (°C.) | Flow speed (m/sec.) | Flow rate | Randomness *1 | Shaping of pattern *2 | Sharpness of pattern *3 | Collective evaluation *4 |
| | | | | | (g/sec./nozzle) | | | | |
| Example 15 | Steam | 2 | 120 | 485 | 0.23 | A | A | A | A |
| Example 16 | Steam | 4 | 151 | 687 | 0.338 | A | A | A | A |
| Example 17 | Steam | 6 | 164 | 781 | 0.391 | A-B | A | A | A-B |
| | | | | | (m³/min./nozzle) | | | | |
| Example 18 | Air | 2 | 20 | 320 | 0.0184 | A | B | A | B |
| Example 19 | Air | 4 | 20 | 432 | 0.0366 | A | B | A | B |
| Example 20 | Air | 6 | 20 | 470 | 0.0548 | A | A-B | A | A-B |

A tricot knit fabric of 120 g/m² was obtained using a single twist yarn (S 120 T/m) of the hollow composite yarn multifilaments (75 deniers/20 filaments) prepared in Example 1 on the face of the fabric and a filament yarn (30 deniers/12 filaments) of polyethylene terephthalate on the back. Then the tricot fabric was relaxed, raised, and dyed in accordance with Example 1. The average fineness of the monofilaments which compose the nap of the obtained raised knit fabric was 0.23 denier. The dyed raised knit fabric was subjected to jet spray treatment under the same conditions as Example 4. The appearance of the raised knit fabric thus jet spray treated was examined with the naked eye and the results are shown in Table 5.

EXAMPLE 22

[Preparation of the raised woven fabric]

Figure 7:
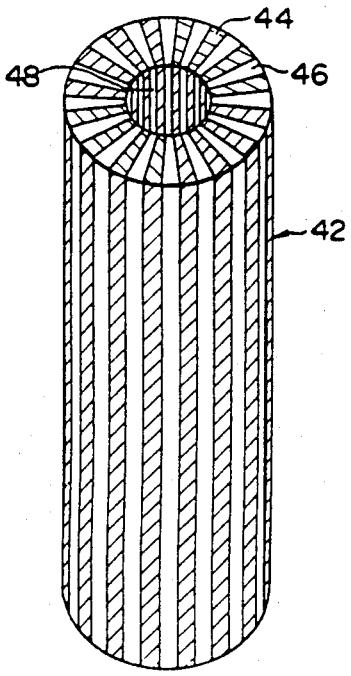

The hollow composite filament was prepared in accordance with the method disclosed in Japanese Patent Application No. 106292/77 from polyethylene terephthalate having an intrinsic viscosity of 0.60 (measured at 35° C. in O-chlorophenol) and polystyrene having a melt index of 20, with polyester components and polystyrene components totalling 32 in number arranged side by side alternately in the form of a ring to make a tubular body which extends along the longitudinal axis of the filament as shown in FIG. 7. In FIG. 7, 42 is the hollow composite filament, 44 the polyester (polyethylene terephthalate) components, 46 the polystyrene components, and 48 the hollow.

In the hollow composite fiber shown in FIG. 7, the ratio of the total weight of the polyester components to that of the polystyrene components was 1:1, and the fineness of the individual component segments was 0.07 and that of the hollow composite fiber was 2.3 deniers. The hollow ratio—the ratio by cross section area of the hollow cavity to the total of the cross section area of the polyester component segments, polystyrene component segments, and the hollow cavity—was 5%.

As for the weft yarn, a single twist filament yarn of said hollow composite fiber multifilaments (600 deniers/260 filaments) having a twist number of S 150 T/m was used, and as for the warp yarn, a twin filament yarn (200 deniers) consisting of two 100 deniers/24 filaments wooly (false twisted) yarns of polyethylene terephthalate and having a twist number of S 150 T/m was used, from which a 4-ply satin having the woven density of 70 warps/inch and 56 wefts/inch was prepared.

The woven fabric thus obtained was relaxed in a hot water bath at a temperature of 98° C. for 30 minutes, and dried at a temperature of 120° C. for 3 minutes. The woven fabric was then washed with trichloroethylene five times and the polystyrene component segments of the hollow composite fiber were all solved and removed substantially. The fabric was dried and an oiling agent mainly consisting of mineral oil was applied thereto. One surface of the woven fabric was raised 15 times with a 33-count wire raising machine at a running speed of 30 m/minute. The raised woven fabric was then pre-heat set at a temperature of 170° C. for 30 seconds using a pin tenter type heat setter. Thereafter, the pre-heat set raised woven fabric was dyed at a temperature of 130° C. for 60 minutes in an aqueous dyeing bath containing 4% (based on the weight of the fabric) of Duranol Blue G (C.I. No. 63305, trademark of a disperse dye produced by I.C.I.), 0.2 ml/l of acetic acid, and 1 g/l of a dispersing agent mainly containing a condensation product of naphthalane sulfonic acid with formamide. The woven fabric was then subjected to soaping with an aqueous solution containing a nonionic detergent at a temperature of 80° C. for 20 minutes, and dried at a temperature of 120° C. for 3 minutes. The average fineness of the monofilaments which constitute the nap of the obtained raised woven fabric was 0.07 denier.

[Jet spray treatment with a high pressure liquid]

The raised woven fabric thus obtained was subjected to a jet spray treatment under the same conditions as Example 4. The appearance of the raised woven fabric thus jet spray treated was examined with the naked eye and the results are shown in Table 5.

TABLE 5

| | Appearance of raised woven fabrics | | | |
|---|---|---|---|---|
| | Randomness *1 | Shaping of pattern *2 | Sharpness of pattern *3 | Collective evaluation *4 |
| Example 21 | A | A | A | A |
| Example 22 | A | A | A | A |

EXAMPLE 23

The raised fabrics (jet spray treated) obtained in accordance with Examples 1–22 were all treated with polyurethane according to the method mentioned below.

The raised fabric was immersed in a dimethylformamide solution containing 10% by weight of polyurethane (reaction product of methylene-diphenyldiisocyanate, polyethylene glycol, and 1,4-butane diol) and then squeezed to a pick-up ratio of 80% based on the weight of the fabric. The impregnated fabric was then immersed in a lot of water to have polyurethane solidified in the fabric. The raised fabric was dried at a temperature of 120° C. for 3 minutes and buffed one time by a roller sander machine with sand paper of 100 mesh, followed by brushing.

The resultant raised fabrics were all suede-like raised fabric having a beautiful appearance, excellent repulsive elasticity and wrinkle resistance.

EXAMPLE 24

The raised fabrics (jet spray treated) obtained in accordance with Examples 1–22 were all treated with a urethane pre-polymer according to the method mentioned below.

[Preparation of urethane pre-polymer]

(1) 21 parts of block copolymeric polyetherdiol having a number average molecular weight of 2400 obtained by adding ethylene oxide to polypropylene glycol having a number average molecular weight of about 1200;
(2) 56 parts of polyesterdiol obtained by reaction of adipic acid, 1,6-hexanediol, and neopentyl glycol mixed at the moleratio of 10:7:4;
(3) 3 parts of 1,6-hexanediol; and
(4) 20 parts of hexamethylene diisocyanate.

The mixture (the mole ratio of an isocyanate group to the active hydrogen atoms being 2.06) consisting of the above was allowed to react at 100° to 105° C. for 1 hour in a stream of nitrogen to make a urethane pre-polymer having an isolated isocyanate group. The content the isolated isocyanate groups in the obtained urethane pre-polymer was 5.02%, the content of the oxyethylene groups were 10.2%.

The obtained urethane pre-polymer was cooled to 40° C. and was diluted by adding 20 parts of dioxane thereto. The obtained solution was mixed thoroughly with 65 parts of an aqueous solution of sodium bisulfite having a concentration of 25% by weight at a temperature of 40° C. for 30 minutes.

Thereafter, 202 parts of water and an adequate amount of hydrogen peroxide were added to the reaction system to obtain an aqueous solution of the urethane pre-polymer having a pH value of 3 and a concentration of about 30% by weight.

[Application of urethane pre-polymer]

The raised fabrics obtained in accordance with Examples 1 to 22 were immersed in a 8% by weight aqueous solution of the abovementioned urethane prepolymer (the pH value was adjusted to 6.0 with sodium bicarbonate), and then squeezed to a pick-up ratio of 70% based on the weight of the fabric. After having been dried at a temperature of 100° C. for 3 minutes, the dried fabric was heat treated at a temperature of 140° C. for 30 seconds. Thereafter, the surface of the raised fabric thus heat treated was buffed one time by a roller sander machine with sand paper of 100 mesh which was followed by brushing.

The raised fabrics thus obtained all had a beautiful appearance of suede, excellent repulsive elasticity, and outstanding crease resistance.

Industrial Applicability

The present invention can be employed profitably for the manufacture of the raised fabric as a substitute for natural suede. The raised fabric obtained in accordance with the present invention has a very soft hand, appearance of lustrous beauty and excellent trailing effect similar to natural suede, and excellent properties such as repulsive elasticity and crease resistance. Accordingly, the suede fabric obtained in accordance with the present invention has wide varieties of use as clothing such as jackets, jumpers, blazers, skirts, trousers, shorts, slacks, dresses, suits, vests, coats, gloves, etc., and also such goods as bags, boots, and upholsteries.

We claim:

1. An apparatus for preparing a suede-like raised fabric comprising a rotatable cylindrical fabric supporter having an imperforate surface with a pattern of random contour variations thereon for supporting a travelling length of said fabric on a portion of the surface thereof, a hollow rotatable cylinder disposed in parallel spaced relation to said fabric supporter and having a liquid passable perforate surface comprised of a 5–300 mesh wire gauze whose meshes are partially and randomly closed so as to provide an open surface area constituting 10–80% of the total surface area, jet nozzles disposed inside said hollow rotatable cylinder with the nozzles directed toward said fabric supporter for randomly directing jets of liquid through said wire gauze onto the fabric and means for rotating said fabric supporter and said cylinder simultaneously to provide a random surface effect on said fabric.

* * * * *